United States Patent [19]

Wankel

[11] 4,296,936

[45] Oct. 27, 1981

[54] SEAL MECHANISM FOR THE ROTOR PERIPHERY OF A ROTARY PISTON ENGINE

[76] Inventor: Felix Wankel, Bregenzer Strasse 82, D-899 Lindau, Fed. Rep. of Germany

[21] Appl. No.: 133,784

[22] Filed: Mar. 25, 1980

[30] Foreign Application Priority Data

Mar. 27, 1979 [CH] Switzerland ..... 2841/79

[51] Int. Cl.[3] ..... F16J 15/48; F01C 19/02

[52] U.S. Cl. ..... 277/81 P; 418/124; 418/191

[58] Field of Search ..... 418/122, 123, 124, 191; 277/81 P, 81 R, 12

[56] References Cited

U.S. PATENT DOCUMENTS 3,171,587 3/1965 Schaller et al. ..... 418/124 X
3,659,503 5/1972 Ehluss et al. ..... 418/124 X
3,873,251 3/1975 Batten ..... 418/123

FOREIGN PATENT DOCUMENTS 221837 9/1942 Switzerland ..... 418/124

*Primary Examiner*—Robert S. Ward, Jr.
*Attorney, Agent, or Firm*—Toren, McGeady & Stanger

[57] ABSTRACT

A seal mechanism for the periphery of the rotor of a rotary piston engine including a sealing ledge supported on the rotor to be pivotable about an axis extending in the longitudinal directional thereof and operative to make sealing contact with an opposed surface of said rotary piston engine over a limited region of the periphery of the sealing ledge facing toward said opposed surface. Through at least one secondary member extending parallel to the sealing ledge at a point of its periphery between the sealing ledge and the rotor, a surface region is defined on the sealing ledge at which forces are developed by the fluid working medium of the engine to effect a desired sealing engagement between the sealing ledge and the opposed surface of the engine.

18 Claims, 15 Drawing Figures

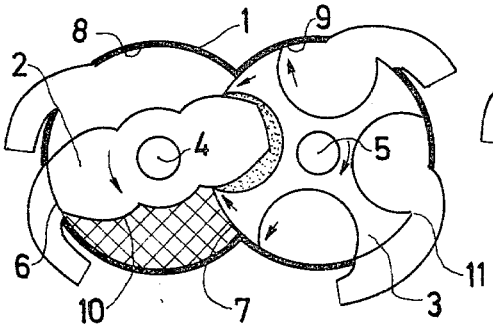
Fig.1
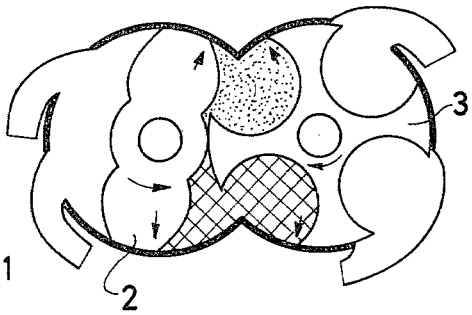
Fig.2
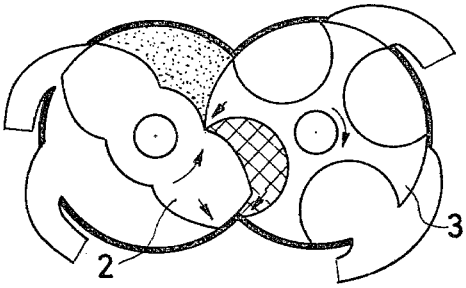
Fig.3
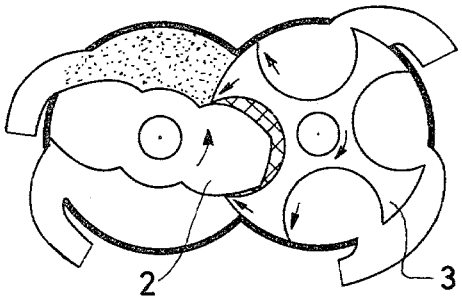
Fig.4
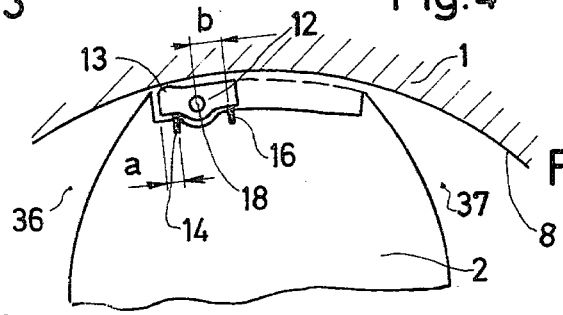
Fig.5
Fig.6
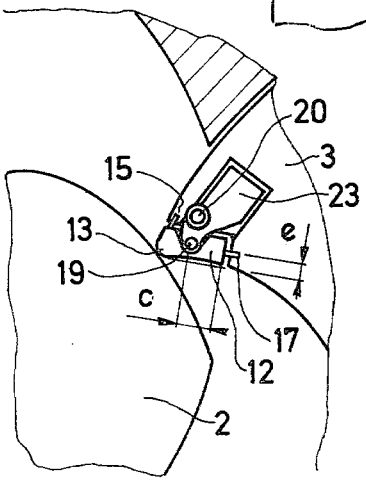
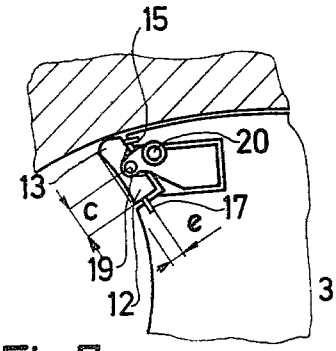
Fig.7
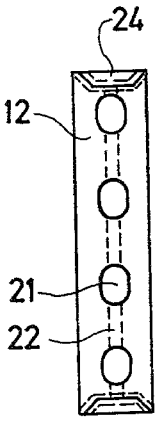
Fig.8

Fig. 9'
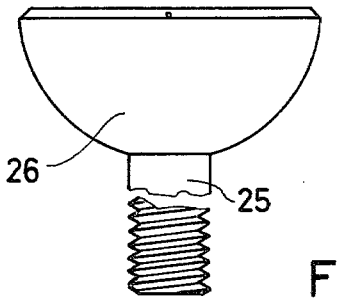
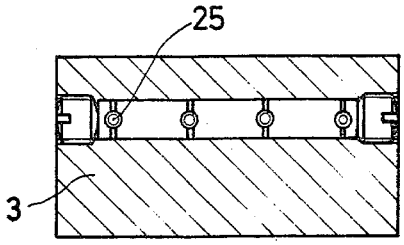
Fig.11
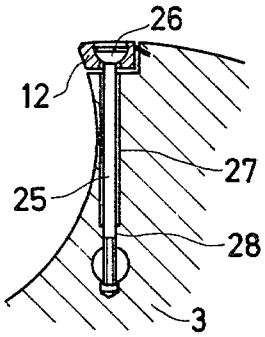
Fig.9
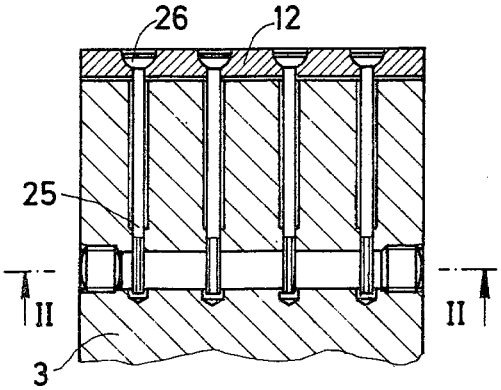
Fig.10
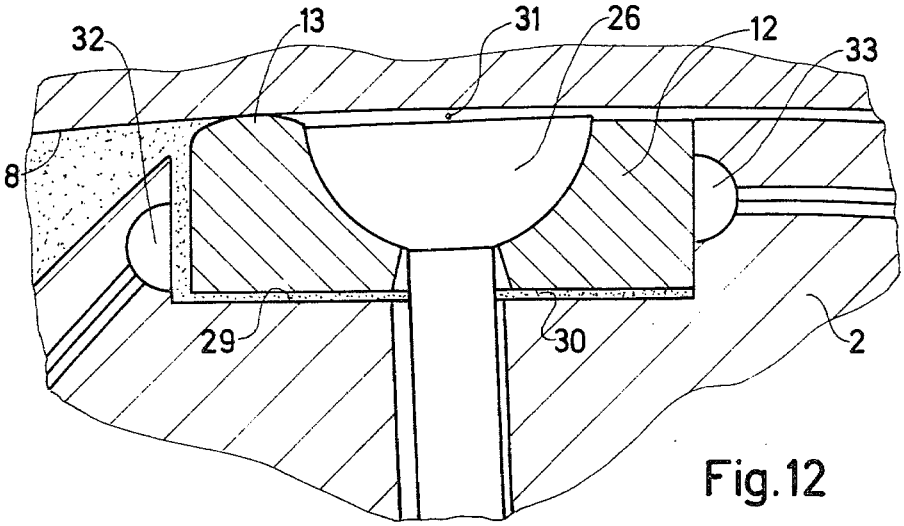
Fig.12

SEAL MECHANISM FOR THE ROTOR PERIPHERY OF A ROTARY PISTON ENGINE

The present invention relates generally to rotary piston engines and more particularly to a seal mechanism arranged on the periphery of the rotor of the rotary piston engine which will effect sealing engagement with an opposed surface of the engine.

The invention is of the type wherein a sealing ledge extends parallel to the axis of the rotor, with the sealing ledge being pivotable relative to the rotor about an axis extending in the longitudinal direction of the sealing ledge. The sealing ledge is intended for contact with the opposed sealing surface of the engine for a limited area of the periphery of the sealing ledge facing toward the opposed engine sealing surface.

Known radial seals or rotary piston engines consist of a sealing member or ledge which is arranged in a longitudinal groove or in an axis-parallel groove of the rotary piston and which is pressed radially upwardly against a slide or running track of the engine housing. To effect a desired sealing contact of the sealing ledge, springs are utilized in some cases. Additionally, gas pressure from a space to be sealed is also utilized.

Centrifugal forces acting on the sealing ledge which result from its rotary movement together with the rotary piston may lead to an undesired high pressure of the sealing ledge and to corresponding wear. Thus, the maximum rate of rotation of the rotary piston engine may be accordingly limited.

Such a radial seal is usually applicable only with continuously extending slide tracks or opposed sealing surfaces which have no discontinuities or breaks since otherwise the sealing ledge would be destroyed or would be forced out of its groove. This limited applicability of known radial seals has prevented further development and use of various types of rotary piston engines known in the art.

The foregoing is particularly true in connection with rotary piston engines having a plurality of rotors wherein the piston bearing is arranged to be stationary and therefore not subjected to centrifugal load so that the rate of rotation is only limited by the strength of the material of the rotary piston when neglecting the structure of the radial seal. Particular difficulties arise in the interaction of more than one rotor of the rotary piston engine when a sealing ledge is to make sealing contact alternatively with a housing surface of the engine and a surface of the other rotor, as is the case for example in rotary piston engines known according to U.S. Pat. No. 3,990,410. In this known seal construction, a stop member prevents the sealing ledges from being forced out of the rotor when they are lifted off the opposed sealing surface. However, the sealing ledge is pressed on by means of centrifugal forces acting thereupon. Moreover, the sealing contact of the sealing ledge is only possible in the radial direction of the rotor.

The present invention is directed to the task of developing a seal mechanism wherein a sealing ledge bears against an opposed sealing surface of the rotary engine with a limited force which can be controlled and which may be developed by means of a relatively simple configuration of the seal mechanism. Additionally, the invention seeks to provide a mode of operation wherein it is possible to guide the sealing ledge along opposed surfaces which may be discontinuous or interrupted.

SUMMARY OF THE INVENTION

Briefly, the present invention may be described as a seal mechanism for the periphery of the rotor of a rotary piston engine operating with a fluid working medium comprising a sealing ledge which extends generally parallel to the axis of the rotor and which is supported on the rotor so as to be pivotable about an axis extending in the longitudinal direction thereof, the sealing ledge being arranged for sealing contact with a limited region of its periphery against an opposed sealing surface of the engine. Secondary seal means are provided at at least one point on the periphery of the sealing ledge extending parallel thereto to act between the sealing ledge and the rotor. The secondary seal means operate to define on the sealing ledge a surface area upon which the pressure of the fluid working medium will act such that there will be developed on the sealing ledge resulting forces having a desired magnitude and direction to place the limited region of the sealing ledge into sealing contact with the opposed sealing surface of the engine.

By defining surface areas of specific sizes where the pressure of the working fluid medium which is to be sealed off may act, for example, in gaps between the sealing ledge and the rotor, the sealing ledge may be pressed into contact with an opposed sealing surface with a desired magnitude and direction even when there is taken into account possible additional centrifugal forces which react on the sealing ledge to cause an imbalance thereof.

The possibility of limiting the contact pressure of the sealing ledge against the opposed sealing surface of the engine enables a lowered frictional resistance and reduced wear of the parts. Additionally, movement between various opposed sealing surfaces is facilitated, as for example in a case where the sealing ledge must move from an opposed sealing surface defined by the machine housing past an interruption or clearing to an opposed sealing surface defined by the machine housing or defined on a counter rotating rotor such as would be provided in a rotary piston engine having a plurality of rotors.

In a preferred embodiment of the invention, the sealing ledge is supported on the rotor, or at least upon a ledge support member connected with the rotor, so as to be rotatable or pivotable about the axis which extends along the center of gravity of the sealing ledge or through the center of gravity of its cross-sectional area, so that the centrifugal forces will have no influence upon pivotal movement of the sealing ledge. In this case, the sealing ledge will be pressed into contact against the opposed sealing surface solely by virtue of the pressure of the working fluid medium of the engine which is to be sealed off by the seal mechanism, which pressure will act against the aforementioned defined surface area of the sealing ledge.

In order to prevent bending of the sealing ledge due to centrifugal forces which could result in nonuniform contact pressure and thus in nonuniform wear in the longitudinal direction of the sealing ledge, another preferred embodiment of the invention advantageously provides at least two ledge supports distributed in the longitudinal direction of the sealing ledge. The ledge supports effect connection of the sealing ledge with the rotor and with the outer ends of the ledge supports pivotally supporting the sealing ledge. In this case, recesses may be provided in the seal mechanism which are engaged by the outer end of a ledge support.

For additional mobility of the sealing ledge in the tangential direction of the rotor, which may be desirable especially for effecting sealing action with a counter rotating rotor, a preferred embodiment of the invention provides that the ledge supports are fastened on the rotor so as to be inherently movable in a manner whereby their outer ends holding the sealing ledge may perform an at least substantially tangential motion. The inherent displaceability of the ledge support may be obtained in an especially simple manner by structuring the ledge support with an elongated flexible shaft having the sealing ledge pivotally supported at the outer end thereof.

As is known from U.S. Pat. No. 3,904,332, in a sealing ledge which is not pivotable, the ledge supports may be constructed as lever members with a counterweight by means of which the centrifugal forces acting at the sealing edge may be partially compensated.

In order to prevent excessive pivotal motion of the peripheral sealing region or sealing edge of the sealing ledge during travel thereof across an interval of the opposed sealing surface along which the sealing edge moves, there may be provided means such as a stop member which will limit the pivotal movement of the sealing ledge to a desired extent. In this manner, undesirably high impact forces acting on the sealing ledge may be prevented when the sealing ledge, after traversing an interval in the opposed sealing surface, moves against the leading edge of a subsequent opposed sealing surface. The sealing ledge need only be pivotable to an extent such that, when taking into account the geometric inaccuracies of the width of the interval between the maximum radius of the rotary piston and the position of the opposed sealing surface, the sealing edge of the sealing ledge will always make contact with a required pressure.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWINGS

In the drawings

FIGS. 1–4 are schematic cross-sectional representations showing various operating positions of a rotary piston engine embodying the present invention and serving as an example of the application of the seal mechanism of the invention;

FIG. 5 is a cross-sectional view of an embodiment of a seal in accordance with the present invention shown in somewhat greater detail;

FIG. 6 is a cross-sectional view of another embodiment of a seal mechanism in accordance with the present invention with the sealing ledge thereof pivotally connected to a lever ledge support member;

FIG. 7 is another cross-sectional view of a seal mechanism according to FIG. 6 shown in a position where sealing is effected at the housing;

FIG. 8 is a side view of the sealing ledge of the invention as viewed from the side thereof facing the rotor;

FIG. 9 is a radial sectional view taken through a portion of the rotor with a preferred embodiment of a sealing ledge according to the invention which acts in a radial and tangential direction;

FIG. 9' is a side view with a part broken away of a ledge support member used in the embodiment according to FIG. 9;

FIG. 10 is an axial sectional view taken through a rotor portion of the embodiment according to FIG. 9;

FIG. 11 is a cross-sectional view taken along the line II—II of FIG. 10;

FIG. 12 is an enlarged radial sectional view taken through a portion of the rotor of another embodiment of the invention.

DETAILED DESCRIPTION OF THE PREFERRED EMBODIMENTS

Figure 13:
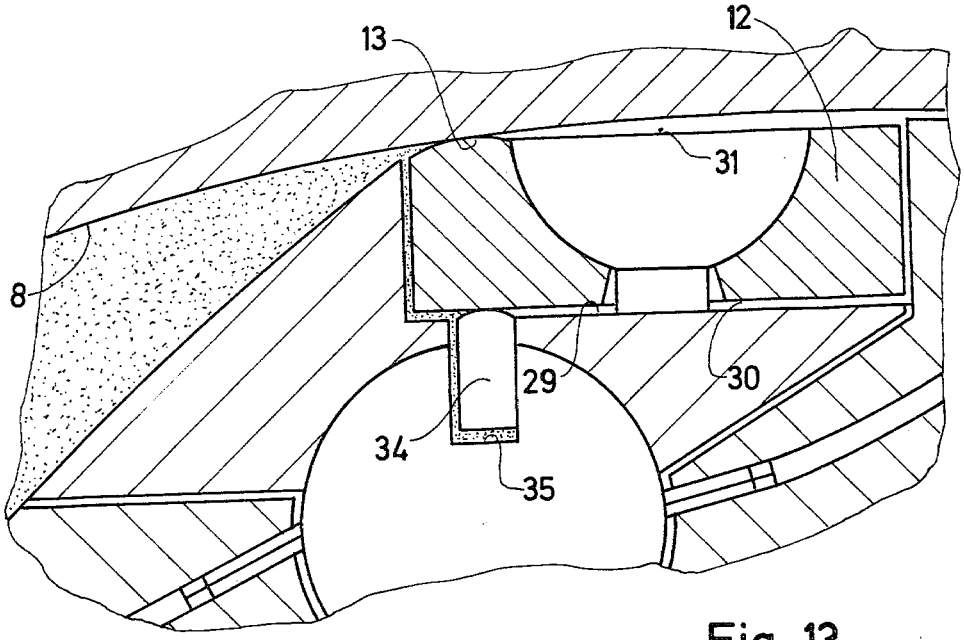
FIGS. 13 and 14 are enlarged radial sectional views taken through a portion of a piston rotor having another embodiment of the invention with various sealing portions of the primary and secondary sealing ledges shown.

Referring now to the drawings, wherein similar reference numerals are used to refer to like parts throughout the various figures thereof, a rotary piston engine having a piston rotor 2 and a sealing or locking rotor 3 which rotate in opposite directions is shown in FIGS. 1–4. The rotary piston engine includes a housing 1 within which the rotors 2 and 3 rotate about respective axes 4 and 5 which extend parallel to each other. The directions of rotation of the rotors 2, 3 are indicated by arrows.

FIGS. 1–4 represent four working positions of the rotors and it will be clear from the drawings how during operation of the engine the working space between the two rotors varies from a maximum volume to a minimum volume while continuously changing shape.

The engine working volume is filled with a fluid working medium and the volume within which compression occurs is identified by cross hatching in FIGS. 1–4 while the working volume within which the working medium expands is indicated by the dotted representation. Peripheral surfaces 6 of the piston rotor 2 and peripheral surfaces 7 of the sealing rotor 3 move over a portion of their circular paths alongside surfaces 8 and 9 defined by the interior of a housing 1 of the engine. It will be obvious that at the points indicated by arrows at the peripheries of the rotors a seal is required between the rotors and the inner surfaces of the housing. Additionally, at certain positions of the rotors, a seal is required between the rotors themselves, wherein a corner 11 of a tooth gap of the rotor 3 must be sealed against a tooth side 10 of the rotor 2. Directions of the arrows indicate required directions of contact pressure.

It will be seen that predominantly radially directed contact pressures occur together with predominantly tangentially directed pressures. Moreover, the representations of FIGS. 1–4 show that the respective sealing members at each rotor will not be in contact with an opposed sealing surface or with an inner surface through a specific distance so that when entering an inner surface they must pass a housing edge or a rotor edge.

The sealing requirements of the engine can be met in a satisfactory manner by a seal mechanism formed in accordance with the present invention because such a seal mechanism is capable of insuring that, along an interval in the sealing surface, the sealing edge will not be moved upwardly under excessive force as a result of the influence of centrifugal forces or the force of the fuel.

FIG. 5 is a partial sectional view of the piston rotor 2 provided with a radial seal. A sealing ledge 12 of the rotor 2 may be rotated through a limited angle about an axle 18 which is supported in or fastened to the piston rotor. If the ledge axle 18 extends along the axis of gravity of the ledge or through the center of gravity of its cross-sectional area, the centrifugal force acting on the ledge will not result in rotation of the ledge and will therefore also not result in contact pressure urging the crest 13 against a sealing surface 8 of the housing, which pressure would be dependent upon the centrifugal force.

Pivotal movement of the sealing ledge required for effective sealing action and to press the crest against the sealing surface of the housing may be effected solely by the pressure developed as a result of the fluid working medium acting upon surfaces of the sealing ledge. By means of one or more ledge-shaped smaller sealing members 14 and 15 shown in FIG. 5 between the sealing ledge 12 and the rotor 2, the area of the sealing ledge upon which gas pressure acts may be limited in such a manner that only torque resulting in a sealing action of the sealing ledge will be produced.

The width a and the width b of the areas acting as described above are indicated in FIG. 5 by dimensional arrows. With respect to the axle 18, gas pressure in a space 36 will act on the area having the width a and gas pressure of a space 37 will act on an area having the width b, the two areas being located to the right and left respectively of the sealing point defined by the crest 13.

FIG. 6 shows the sealing rotor 3 equipped with a radially and tangentially acting sealing ledge. In the sealing member of the embodiment according to FIG. 6, an axle 19 of the sealing ledge 12 may be moved relative to the sealing rotor 3 along a circular path about a second axle 20, the second axle 20 being arranged on an outer end of a lever-like ledge support 23. The ledge support 23 acts as a counterweight counteracting the centrifugal force acting on the ledge 12 so that the resulting centrifugal force extends through the axle 20 and accordingly there occurs no contact pressure by the crest of the sealing ledge against the sealing surface of the tooth side 10 of the piston rotor 20.

However, in the example shown in FIG. 5, as well as in the example of FIG. 6, the axles 18, 19 and 20 may also be arranged in such a manner that the resulting centrifugal force effects a small torque about these axles with the resulting force on the crest of the sealing ledge depending upon the dimensions of the respective selected lever arms.

In the examples depicted in FIGS. 6 and 7, movement of the sealing ledge 12 producing a sealing contact pressure is effected by the resulting gas pressure acting on the ledge. In FIG. 6, the gas pressure acting on an area having a width c determines pivotal movement about the ledge axle 19 and an approximately tangentially directed contact pressure of the sealing ledge crest 13 against the piston rotor 2. Gas pressure acting on an area having a width e determines, in FIG. 7, pivotal movement about the axle 20 and thus an approximately radially directed contact pressure of the sealing ledge crest 13. These areas are all defined by the arrangement of ledge-shaped sealing members 15 and 17.

FIG. 8 shows a seal mechanism comprising a sealing ledge 12 which may be formed, for example, in accordance with the embodiments of FIGS. 6 or 7, the ledge 12 in FIG. 8 being shown from the side facing toward the rotor. A plurality of cutouts 21 formed in the ledge 12 are visible in FIG. 8 and are uniformly distributed in the longitudinal direction of the ledge 12. Into each of the cutouts 21 there may engage or extend an outer end of a ledge support 23 which effects connection of the sealing ledge 12 to the rotor 3. In a longitudinal bore 22 which intersects with the cutouts 21, there may be inserted an axle which effects the connection with the ends of ledge support 23 so that the ledge 12 will be pivotable about this axle. On the ends of the sealing ledge 12 there are provided beveled guide shoes 24 for effecting sealing action against the side surfaces of the engine housing.

In the embodiments depicted in FIGS. 9–14, elongated slender shafts 25 serve as the ledge supports and extend through bores 27 of the rotor 3. The diameter of each of the bores 27 is made somewhat larger than the diameter of a shaft 25 extending therein so that the shafts 25 may experience within the bores 27 a bending movement similar to the bending of a spoke of a bicycle wheel. On the other end of each of the shafts 25 there is formed a head 26 through which the sealing ledge 12 is held or supported. The surface of the head 26 facing toward the shaft 25 (FIG. 12) is formed with a semi-spherical or cylindrical configuration and as a result of this configuration and the configuration of the corresponding receiving recess in the sealing ledge 12, the sealing ledge 12 may pivot about a center 31 of the spherical or cylindrical surface.

It is also possible to provide other types of articulated connections between the shaft end and the sealing ledge, for example, by means of an axle fastened on the end of a shaft or on the sealing ledge and a bore in the other member which surrounds the axle.

Finally, it is also possible to provide a strap instead of the shaft 25 so that a connection with the sealing ledge 12 may be effected which is comparable to a strap hinge.

Because of the fact that the shaft 25 of the ledge support member may be bent within the bore 27, the shaft head 26 and, thus, the sealing ledge supported by the shaft head will be movable in a tangential direction relative to the rotors 2, 3 so that the sealing ledge depicted in FIG. 9, in a manner similar to the sealing ledge depicted in FIGS. 6 and 7, may act in a radial as well as in a tangential direction. The centrifugal forces acting upon the sealing ledge are absorbed by the shaft 25 so that the ledge support does not need to have a counterweight as in the example shown in FIGS. 6 and 7. The end of the shaft 25 which is directed toward the center of the rotors 2 and 3 is inserted and fastened in a bore 28 having a diameter which corresponds to the shaft diameter, the bore 28 being contiguous to the bore 27.

FIG. 12 shows in an enlarged representation a radial seal of a piston rotor 2 which is structured in a manner similar to the radial-tangential seal according to FIGS. 9–11, the most important difference residing in the fact that the tangential movement of the sealing ledge 12 made possible by the shaft-like sealing ledge supports is utilized for the sealing contact at the side of the sealing ledge with the sidewalls of its axial groove 29 in the rotor 2. The groove 29 has a somewhat larger cross section than the sealing ledge so that gap spaces 30 are provided between the sealing ledge and the groove walls, with the fluid working medium which is to be sealed penetrating into these spaces. As a result, the sealing ledge, in an action similar to that of a piston ring in its groove, is lifted by the working medium from the respective sidewall of the groove where the medium flows in, and it is pressed against the respective sidewall of the groove where the medium flows off. The sealing crest 13 is pressed against the oppositely located surface 8 by means of the working medium located beneath the sealing ledge 12. Pressing of the sealing ledge crest 13 against the opposed sealing surface 8 is facilitated by pivotal movement of the sealing ledge 12 about its axis of rotation 31.

Figure 14:
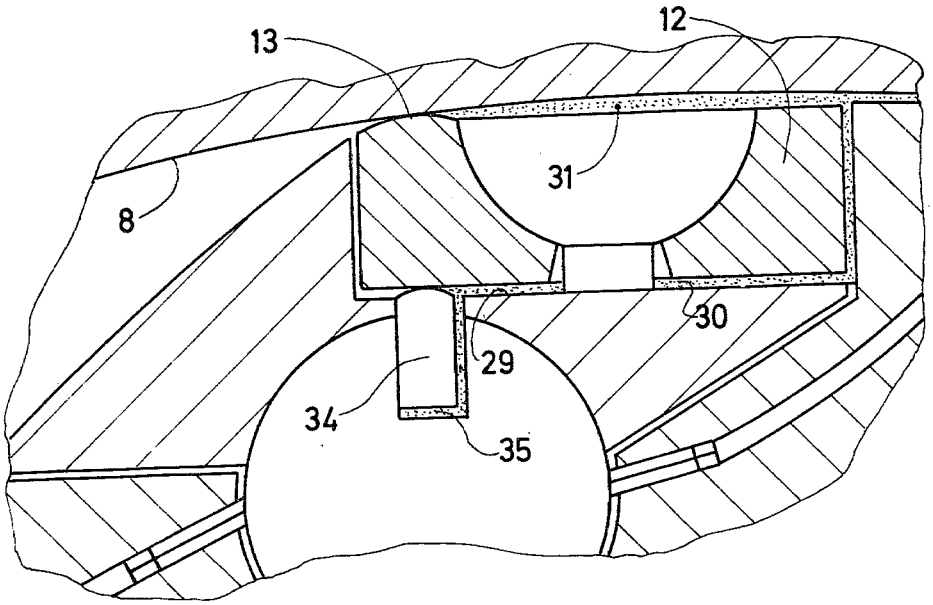

In FIGS. 12–14, a dotted shading indicates the working medium to be sealed off which is under an increased pressure. During operation of the rotary piston engine, pressure will change from one side of the sealing ledge to the other, as indicated in the example of FIG. 12 by the dotted shading, so that the sealing ledge of the FIG. 12 embodiment will perform a swinging reciprocal movement.

In the example according to FIG. 12, secondary sealing ledges 32 and 33 having a semi-spherical cross section are arranged in the sidewalls of the rotor groove 29 and are connected with a sealing boundary, as described for example German Pat. No. 1,148,824.

FIGS. 13 and 14 show a seal mechanism wherein the sealing ledge support is constructed in accordance with the example of FIG. 12 so that similar reference numerals are used to identify the same parts.

In this example, a secondary ledge 34 which has an essentially rectangular cross section rests against the bottom side of the sealing ledge 12 and is arranged in a groove 35 having a cross section which is somewhat larger than the cross section of the secondary sealing ledge 34 in order that there is formed a gap or space therebetween.

FIG. 13 shows the respective position of the secondary sealing ledge 34 when the higher pressure of the working medium is on that side of the sealing ledge 12 which faces toward the sealing ledge crest 13, i.e., on the left side as illustrated herein. Thus, the secondary sealing ledge 34 bears tightly with its right sealing surface against the sidewall of its groove where the medium will flow off.

FIG. 14 shows the position of the sealing ledge 34 or, respectively, of its shifting relative to the position according to FIG. 13. The gap space in which the pressure of the working medium acts for pressing upon the sealing ledge is illustrated by means of dotted shading. In the two positions of FIGS. 13 and 14 it will be seen that the pressure of the working medium in the gap spaces leads to a resulting force producing a torque about the axis of rotation 31 of the sealing ledge 12 so that the sealing ledge crest 13 is pressed against the opposite sealing surface 8. Through the selected width of the groove 35 for receiving the secondary sealing ledge 34, the magnitude of the torque resulting from the effective gas pressure area may be influenced.

While specific embodiments of the invention have been shown and described in detail to illustrate the application of the inventive principles, it will be understood that the invention may be embodied otherwise without departing from such principles.

What is claimed is:

1. A seal mechanism for the periphery of the rotor of a rotary piston engine operating with a fluid working medium comprising: a sealing ledge extending generally parallel to the axis of said rotor and supported on said rotor so as to be pivotable about an axis extending in the longitudinal direction thereof, said sealing ledge being arranged for sealing contact along a limited region of its periphery with an opposed sealing surface in said engine; and secondary seal means provided at at least one point on the periphery of said sealing ledge extending parallel thereto and acting between said sealing ledge and said rotor, said secondary seal means operating to establish on said sealing edge a surface area upon which the pressure of said fluid working medium acts such that there are developed on said sealing ledge resulting forces having a desired magnitude and directed to place said limited region of said sealing ledge into sealing contact with said opposed sealing surface.

2. A seal mechanism according to claim 1 wherein said sealing ledge is supported so as to be pivotable relative to said rotor about an axle.

3. A seal mechanism according to claim 2 wherein said axle is mounted on a ledge support connected with said rotor.

4. A seal mechanism according to claim 2 wherein said axle extends at least approximately through the center of gravity of the cross section of said sealing ledge.

5. A seal mechanism according to claim 2 wherein said axle is located in a median plane of said sealing ledge.

6. A seal mechanism according to claim 1 or 2 wherein there are provided a plurality of ledge supports distributed in the longitudinal direction of said sealing ledge to effect connection of said sealing ledge with said rotor, said sealing ledge being pivotally supported on an outer end of said ledge supports.

7. A seal mechanism according to claim 6 wherein said outer end of said ledge supports engages in a cutout of said sealing ledge.

8. A seal mechanism according to claim 1 further comprising ledge support means having outer ends supporting said sealing ledge and movably mounted on said rotor so that said outer ends are movable with respect to said rotor in an at least approximately tangential direction.

9. A seal mechanism according to claim 6 wherein said ledge supports comprise an elongated shaft having an inner end fastened to said rotor and an outer end having said sealing ledge pivotally supported thereon, said shaft of said ledge support extending through a bore in said rotor, said bore having a diameter larger than the diameter of said shaft, said shaft being flexible within said bore so that said sealing ledge may be pivoted about a second axis which extends through the fastening region of the inner end of said shaft of each of said ledge supports.

10. A seal mechanism according to claim 9 wherein said outer end of each of said ledge supports is formed with a head which, at least on the side thereof facing toward the inner end of said shaft, is formed with a curved surface extending parallel to the longitudinal direction of said ledge and bearing against a correspondingly shaped surface of said sealing ledge so that said curved surface of said head forms a support surface for pivotal movement of said sealing ledge.

11. A seal mechanism according to claim 6 wherein said ledge supports are constructed as lever members pivotable about a support axle which is connected with said rotor and wherein a counterweight of said lever members compensates at least partially centrifugal forces acting on said sealing ledge.

12. A seal mechanism according to claim 11 wherein said secondary means comprise ledge-shaped sealing means which define surface areas of said sealing ledge upon which the pressure of the working medium to be sealed by said seal mechanism acts, said pressure leading to a torque about the axis of said sealing ledge and about said support axle of said ledge support.

13. A seal mechanism according to claim 1 comprising stop means for limiting movement of said sealing ledge.

14. A seal mechanism according to claim 1 wherein said secondary seal means comprises at least one steel band held in a groove of at least one of said rotor and of said sealing ledge.

15. A seal mechanism according to claim 1 wherein said secondary seal means comprises a secondary sealing ledge having a cross section which is smaller than the cross section of said sealing ledge and which is enclosed in a groove formed in said rotor, said groove being formed in conformance with the cross section of said secondary sealing ledge so that the cross section of said groove is larger than the cross section of said secondary sealing ledge in order to form a gap space therebetween wherein said working medium to be sealed by said sealing mechanism may flow, said secondary sealing ledge being movable in said groove transversely of the longitudinal direction thereof with the pressure of said medium in said gap space between the wall of said groove and said secondary sealing ledge resulting in a pressure on said secondary sealing ledge urging said secondary sealing ledge against a wall of said groove and a surface of said sealing ledge.

16. A seal mechanism according to claim 9 wherein said inner shaft end is profiled and wherein said support members are enclosed in a bore extending transversely of the receiving bore in said inner shaft end, said support members having a similar profile enclosing between them the profiled shaft ends.

17. A seal mechanism according to claim 16 wherein said profiled end comprises a threaded configuration.

18. A seal mechanism according to claim 1 wherein said sealing ledge and said secondary seal means are enclosed in grooves which are formed to be at least bounded by a profiled member which is releasibly fastened in a recess of said rotor extending to the rotor axis.

* * * * *